US007458775B2

(12) United States Patent
Shyu

(10) Patent No.: US 7,458,775 B2
(45) Date of Patent: Dec. 2, 2008

(54) MAGNETICALLY OPERATED FAN DEVICE

(76) Inventor: Shin Fa Shyu, No. 30, Yuansi Road, Changnan Tsuen, Yuanchang Hsiang, Yunlin Hsien 655 (TW)

( * ) Notice: Subject to any disclaimer, the term of this patent is extended or adjusted under 35 U.S.C. 154(b) by 959 days.

(21) Appl. No.: 11/005,905

(22) Filed: Dec. 7, 2004

(65) Prior Publication Data

US 2006/0251530 A1 Nov. 9, 2006

(51) Int. Cl.
*F03G 7/00* (2006.01)
*H02K 49/00* (2006.01)
*H02P 15/00* (2006.01)

(52) U.S. Cl. ..... 416/3; 416/170 R; 416/173; 310/1; 310/103

(58) Field of Classification Search ..... 416/3, 416/170 R, 173; 310/1, 103
See application file for complete search history.

(56) References Cited

U.S. PATENT DOCUMENTS 5,304,035 A 4/1994 Carter ..... 416/63
5,558,501 A 9/1996 Wang et al. ..... 416/244 R
6,998,723 B2 * 2/2006 Kong et al. ..... 290/1 C
2004/0140722 A1 * 7/2004 Long ..... 310/80
2005/0023916 A1 * 2/2005 Moe ..... 310/103
2007/0007835 A1 * 1/2007 Wise ..... 310/80
2007/0262665 A1 * 11/2007 Park ..... 310/80

* cited by examiner

*Primary Examiner*—Ramon M Barrera
(74) *Attorney, Agent, or Firm*—Charles E. Baxley

(57) ABSTRACT

A magnetically operated fan device includes a fan member rotatably supported on a housing, one or more magnetic members disposed in the housing, a base supported in the housing, a follower rotatably attached to the base and having a frame, an axle rotatably attached to the frame and having one or more eccentric members for increasing moment of inertia of the axle, one or more magnetic members attached to the eccentric member for acting with the magnetic members of the housing, to bias the axle to continuously rotate relative to the frame of the follower. A coupling device may couple the axle to the fan member, to have the fan member to be driven continuously by the magnetic members and the eccentric members.

19 Claims, 12 Drawing Sheets

MAGNETICALLY OPERATED FAN DEVICE

BACKGROUND OF THE INVENTION

1. Field of the Invention

The present invention relates to a fan device, and more particularly to a fan device automatically operatable or drivable with magnetic materials or members without consuming valuable and expensive electric energy.

2. Description of the Prior Art

Various kinds of typical fan devices have been developed and comprise a motor coupled to a fan member, in order to rotate or to drive the fan member to generate circulating air.

For example, U.S. Pat. No. 5,304,035 to Carter discloses one of the typical fan devices which comprises a greatly reduced size or volume that may be easily attached to the users with such as cord, and to be carried by the users. The typical fan device also comprises a motor coupled to a fan member, in order to rotate or to drive the fan member to generate circulating air.

U.S. Pat. No. 5,558,501 to Wang et al. discloses another typical fan device which comprises an adjustable post assembly for easily and adjustably attach the typical fan device to various locations or positions. Similarly, the typical fan device also comprises a motor coupled to a fan member, in order to rotate or to drive the fan member to generate circulating air.

At present, the motors of the typical fan devices are all required to be driven or operated by electric energy, and may not be operated or driven without electric energy.

The present invention has arisen to mitigate and/or obviate the afore-described disadvantages of the conventional electrically operated fan devices.

SUMMARY OF THE INVENTION

The primary objective of the present invention is to provide a fan device automatically operatable or drivable with magnetic materials or members without consuming valuable and expensive electric energy.

In accordance with one aspect of the invention, there is provided a magnetically operated fan device comprising a housing, a fan member rotatably supported on the housing, at least one first magnetic member disposed in the housing, a base supported in the housing, a follower rotatably attached to the base, and including a frame provided thereon, an axle rotatably attached to the frame of the follower, and including at least one eccentric member attached to the axle and rotated in concert with the axle, for increasing moment of inertia of the axle, a second magnetic member attached to the eccentric member, for acting with the first magnetic member of the housing, to bias and force the axle to continuously rotate relative to the frame of the follower and the housing, and a coupling device for coupling the axle to the fan member, to have the fan member to be rotated and driven by the axle and by continuously rotation of the second magnetic member and the eccentric member and the axle relative to the frame of the follower and the housing, without consuming electric energy.

One or more spring members may further be disposed between the second magnetic member and the eccentric member. The eccentric member includes at least one cavity formed therein to partially receive the spring member. The second magnetic member includes at least one stud extended therefrom to engage through the spring member.

The coupling device includes a rotary member rotatably attached to the housing, a shaft rotatably attached to the rotary member and coupled to the fan member, a first pinion disposed on the shaft, a second pinion disposed on the axle, and a coupling member engaged with the first and the second pinions, to couple the shaft and the axle together, and to allow the fan member to be rotated and driven by the axle via the shaft.

The housing includes a casing provided thereon, and the fan member includes a spindle rotatably attached to the casing, a first bevel gear attached to the spindle and rotated in concert with the spindle, and a second bevel gear attached to the axle, and engaged with the first bevel gear. The axle includes a pulley attached thereon, and a rope for engaging around the pulley, and for rotating the axle with the pulley.

The axle includes a pinion attached thereto, and a pawl pivotally attached to the frame, and biased to engage with the pinion, in order to limit a rotational movement of the axle relative to the frame. The follower includes a gear provided thereon, and a pawl pivotally attached to the base, and biased to engage with the gear, in order to limit a rotational movement of the gear and the follower relative to the base.

An arm is pivotally attached to the base and includes a third magnetic member disposed thereon, the housing includes a fourth magnetic member rotatably disposed therein and arranged for acting with the third magnetic member, to either bias the third magnetic member and thus the arm and the base away from the fourth magnetic member.

The housing includes a seat disposed therein and having the fifth magnetic member rotatably attached to the seat with a rod, and a handle coupled to the rod to rotate the rod and the fifth magnetic member relative to the seat and the fourth magnetic member, and a spring member for recovering the rod and the fifth magnetic member.

The arm includes a fifth magnetic member disposed thereon, the housing includes a column attached thereto and having a sixth magnetic member disposed therein for acting with the fifth magnetic member, to balance the fifth magnetic member and thus the arm and the base relative to the housing.

The housing includes a horizontal beam pivotally attached thereto and having an extension extended downwardly therefrom and pivotally attached to a lever, and the lever is pivotally attached to the base, to allow the base to slightly move freely relative to the housing.

The follower includes a third magnetic member attached thereto and includes a gear provided thereon, and the base includes at least one pinion rotatably attached thereto and a fourth magnetic member attached to the pinion, for acting with the third magnetic member, and to bias and to rotate the follower relative to the base. The base includes at least one platform extended therefrom, to rotatably support the pinion.

The housing includes a first track and a second track disposed thereon, and each having a third magnetic member attached thereto, the base includes two fourth magnetic members attached thereto and arranged to act with the third magnetic members of the tracks, to bias and force the base upwardly relative to the housing, and to suspend and float the base in the housing.

The first track is attached to the housing with a spring member. The second track is attached to the housing with a protrusion and a pivot pin. The first and the second tracks each includes a channel formed therein to slidably receive the fourth magnetic members of the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
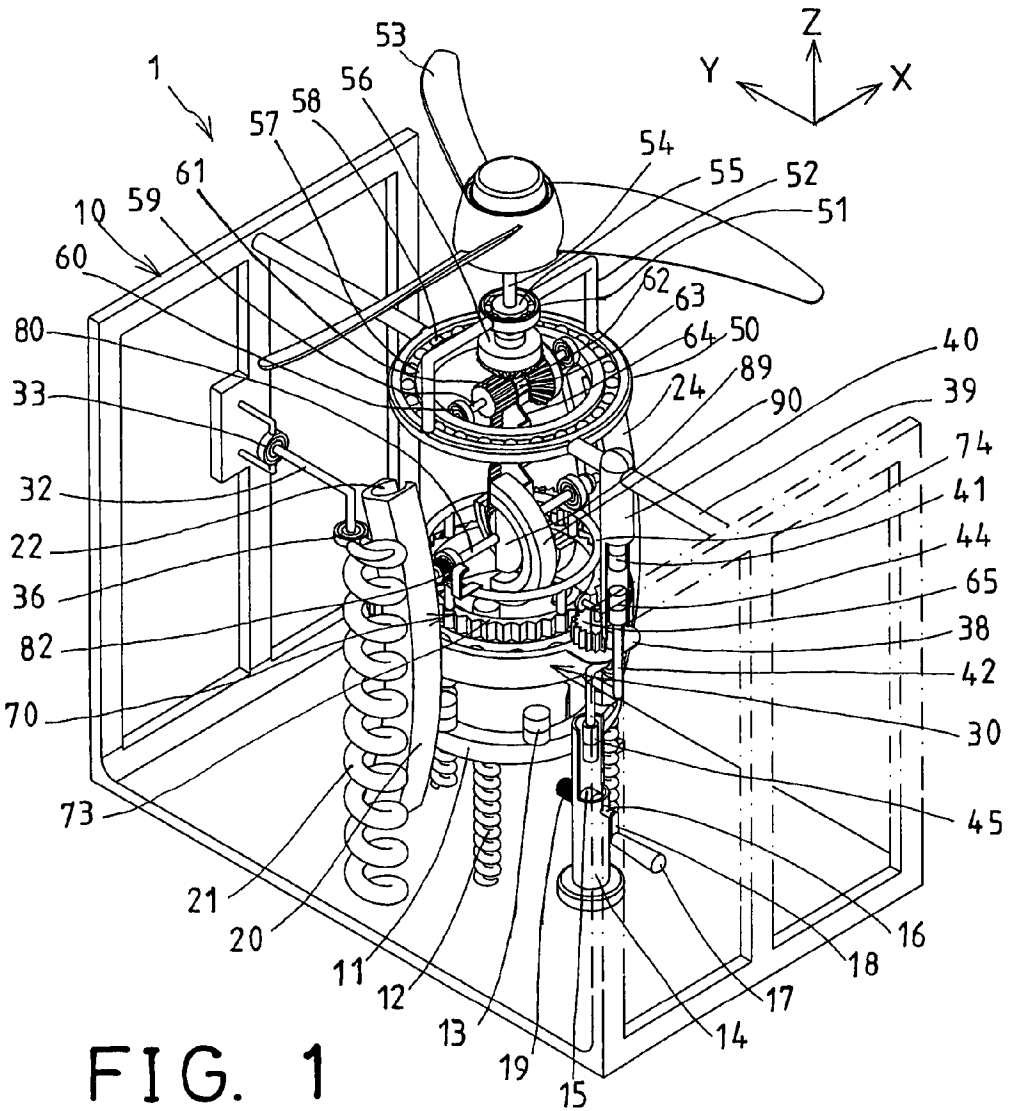
FIG. 1 is a perspective view of a magnetically operated fan device in accordance with the present invention.
Figures 2, 3:
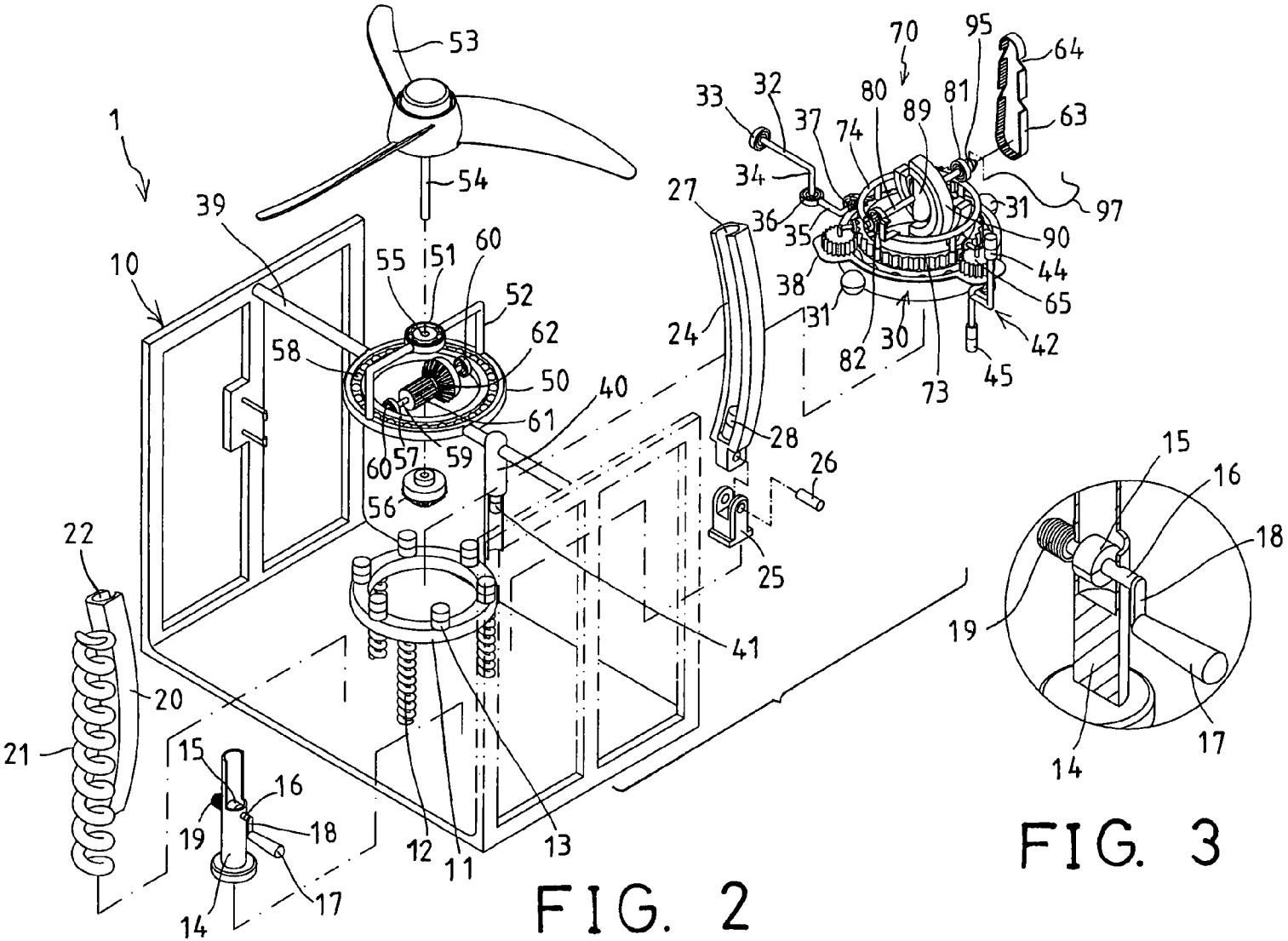
FIG. 2 is a partial exploded view of the magnetically operated fan device.
FIG. 3 is an enlarged partial perspective view of the magnetically operated fan device, in which a portion of the fan device is cut off to show inner structure of the fan device.
Figure 4:
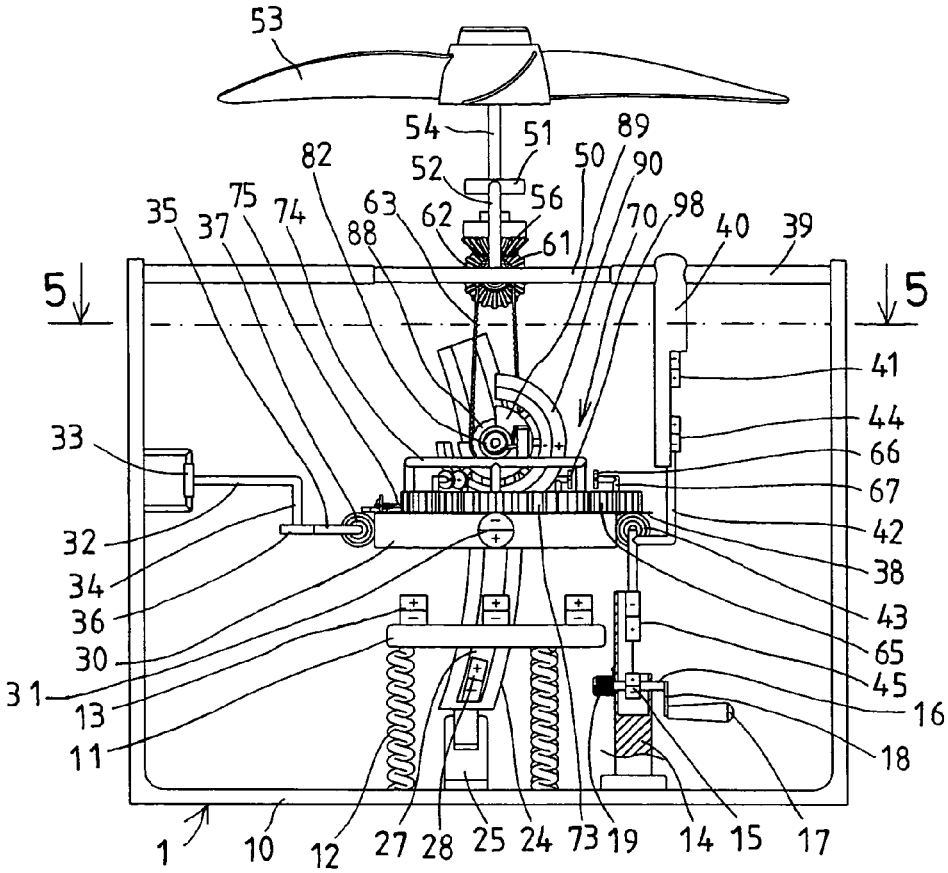
FIG. 4 is a plan view of the magnetically operated fan device.

Referring to the drawings, and initially to FIGS. 1-6, a magnetically operated fan device 1 in accordance with the present invention comprises a housing 10 including a support element 11 disposed therein, and resiliently supported by one or more spring members 12, and one or more magnetic members 13 disposed on the support element 11, and including a seat 14 disposed therein.

A magnetic member 15 is disposed in and rotatably attached to the seat 14 with a rod 16, and a handle 17 is coupled to the rod 16 with a crank 18, to allow the rod 16 and thus the magnetic member 15 to be rotated relative to the seat 14 by the handle 17 via the crank 18. A spring biasing or recovering member 19 is coupled to the rod 16, in order to recover the rod 16, and thus to position the magnetic member 15 at required positions, such as to have the negative or the positive pole of the magnetic member 15 to be arranged or directed downwardly or upwardly.

A track 20, such as a curved track 20 is resiliently supported in the housing 10 with a spring member 21, and includes a channel 22 formed therein, and includes a magnetic member 23 disposed therein (FIG. 6), such as disposed in the bottom portion thereof. Another track 24, such as a curved track 24 is also supported in the housing 10 and includes a lower portion rotatably or pivotally attached to a protrusion 25 of the housing 10 with a pivot pin 26, and also includes a channel 27 formed therein and preferably aligned with the channel 22 of the curved track 20, and also includes a magnetic member 28 disposed therein (FIG. 6), such as disposed in the bottom portion thereof.

A base 30 includes one or more, such as two magnetic members 31 attached thereto or extended therefrom, and slidably engaged in the channels 22, 27 of the tracks 20, 24 (FIG. 6), and the magnetic members 23, 28, 31 of the tracks 20, 24 and of the base 30 are arranged to have the same magnetic poles facing toward each other, in order to force the magnetic members 23, 28 and 31 away from each other, and so as to bias or to force the base 30 upwardly away from the support element 11, or upwardly relative to the housing 10, or upwardly relative to the tracks 20, 24, in order to suspend or float the base 30 in the housing 10.

A lateral or horizontal beam 32 includes one end rotatably or pivotally attached to a side portion of the housing 10 with a bearing or pivot joint 33, and includes an extension 34 extended downwardly therefrom and rotatably or pivotally attached to a lateral or horizontal lever 35 with another bearing or pivot joint 36, and the lever 35 is rotatably or pivotally attached to the base 30 with a further bearing or pivot joint 37, and arranged to allow the base 30 to slightly move freely in either X, Y or Z direction relative to the housing 10 (FIG. 1), and may also be used to limit the base 30 to move relative to the housing 10. The base 30 includes one or more platforms 38 laterally extended therefrom.

The housing 10 includes an upper portion 39 having a column 40 attached thereto or extended downwardly therefrom, and a magnetic member 41 disposed in the column 40. An arm 42 includes a middle portion rotatably or pivotally attached to or coupled to the base 30 with a bearing or pivot joint 43, and includes a further magnetic member 44 attached on top thereof, and disposed below or close to the magnetic member 41, for acting with the magnetic member 41, and thus for balancing the base 30, and/or to further limit the base 30 to move relative to the housing 10.

The arm 42 further includes a lower portion having a still further magnetic member 45 attached thereto, and disposed above or close to the magnetic member 15, for acting with the magnetic member 15. For example, the magnetic members 15, 45 of the seat 14 and of the arm 42 are normally arranged to have the same magnetic poles facing toward each other, to have the magnetic members 15, 45 forced away from each other (FIG. 4), and thus to bias or to force the base 30 upwardly away from the support element 11, or upwardly relative to the housing 10, in order to suspend or to float or to buoy the base 30 in the housing 10 in a horizontal status or position.

It is to be noted that the magnetic member 15 may be rotated relative to the seat 14 by the handle 17 with the crank 18, to allow the magnetic member 15 to be rotated or changed to have different magnetic poles of the magnetic members 15, 45 to be faced toward each other, and thus to attract the magnetic members 45 downwardly toward the magnetic members 15, and thus to tilt the base 30 relative to the housing 10.

When the handle 17 is released by the users, the rod 16 and thus the magnetic member 15 may then be biased and recovered back to the original or required position by the spring biasing or recovering member 19, where the same magnetic poles of the magnetic members 15, 45 are faced toward each other (FIG. 4), in order to bias the base 30 upwardly relative to the housing 10 again, and so as to suspend or float the base 30 in the housing 10 at the original or required horizontal status or position.

A casing 50 is formed or provided on the upper portion 39 of the housing 10 and includes a ring 51 disposed or supported thereon with one or more L-shaped struts 52. A fan member 53 includes a spindle 54 rotatably attached or secured to the ring 51 of the casing 50 with a bearing or pivot joint 55, to allow the fan member 53 to be rotatably attached or secured to the casing 50. A worm or bevel gear 56 is attached to the spindle 54, and rotated in concert with the spindle 54 and the fan member 53.

As shown in FIGS. 1, 2, 4 and 6-8, a rotary member 57 is rotatably attached or secured to the casing 50 with a bearing or pivot joint 58. A shaft 59 is rotatably attached or secured to the rotary member 57 with one or more bearings or pivot joints 60. A sprocket or a pinion 61 and another worm or bevel gear 62 is attached to the shaft 59, and rotated in concert with the shaft 59. The bevel gear 62 is engaged with the bevel gear 56 of the spindle 54, to allow the fan member 53 to be rotated or driven by the shaft 59.

A coupling member 63, such as a chain or a belt 63 is engaged with or around the pinion 61, and preferably includes one or more spring members 64 engaged therein, for allowing the coupling member 63 to be slightly stretched or prolonged or lengthened, when the magnetic members 45 is attracted downwardly toward the magnetic members 15, and when the base 30 is tilted relative to the housing 10.

Figure 12:
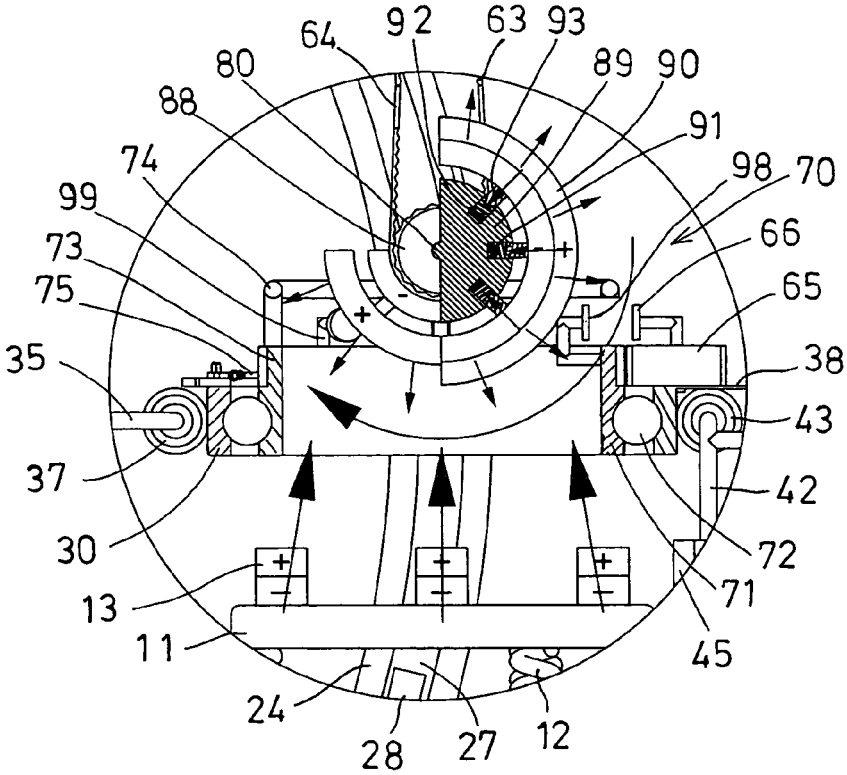
FIG. 12 is a partial cross sectional view taken along lines 12-12 of FIG. 9.

Referring next to FIGS. 9-12, and again to FIGS. 1-2 and 4-6, the magnetically operated fan device 1 further includes a magnetic driving device 70 having a follower 71 rotatably attached or coupled to the base 30 with a number of balls or a bearing 72, best shown in FIG. 12, and having a gear 73 disposed on or attached to or extended from the follower 71, and a frame 74 attached to or disposed on the gear 53 or the follower 51.

Figure 5:
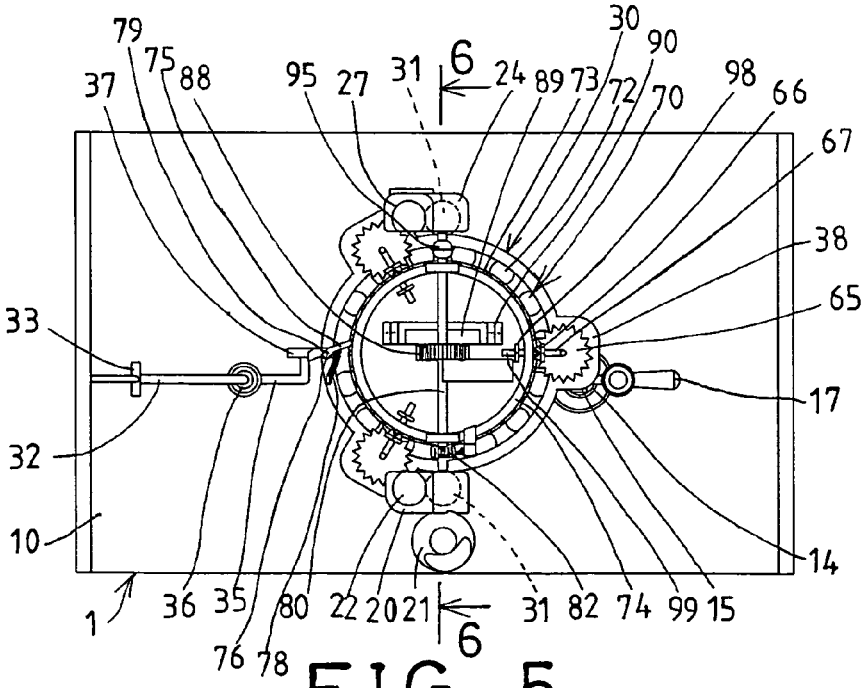
FIG. 5 is a partial cross sectional view taken along lines 5-5 of FIG. 4.
Figure 6:
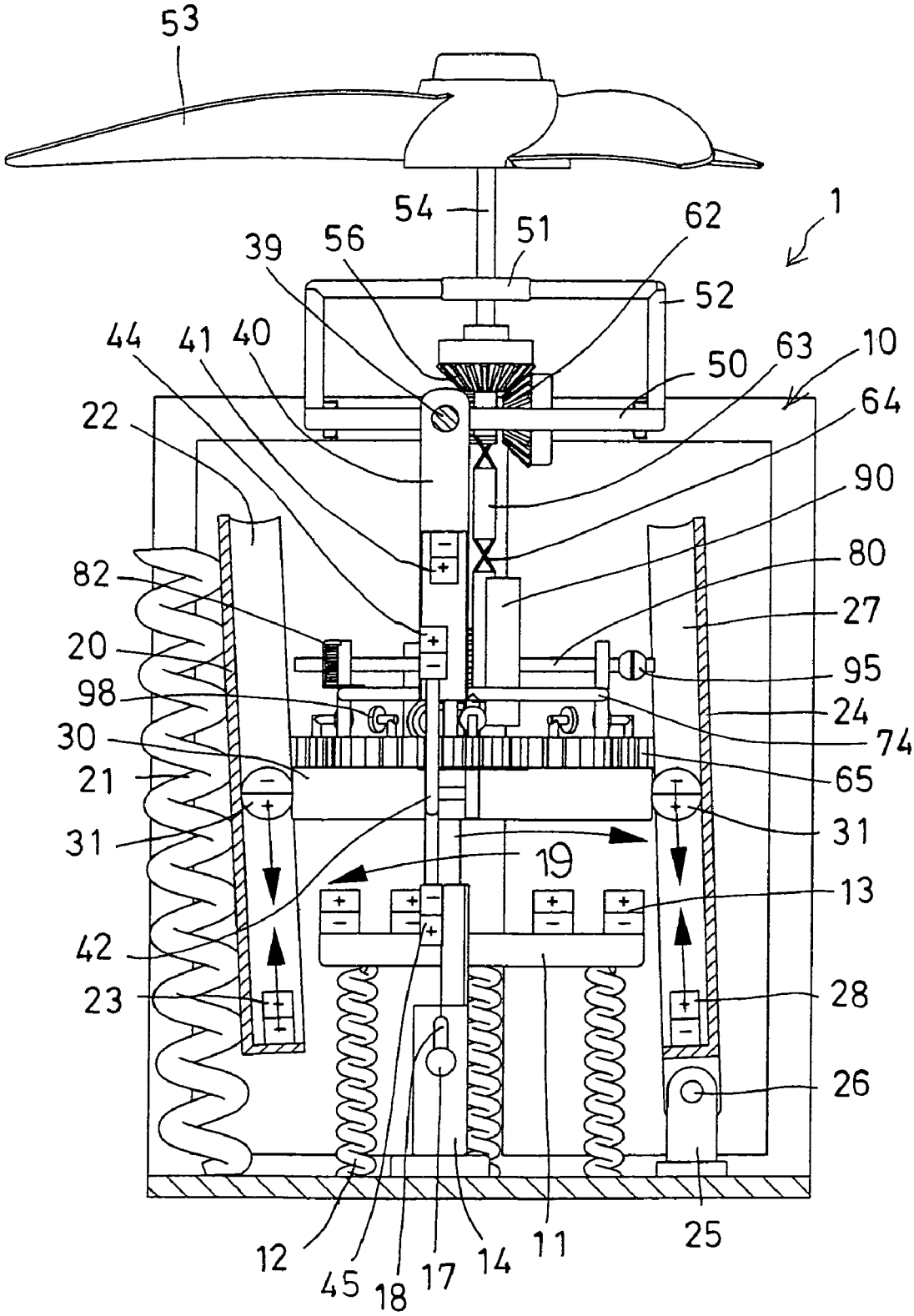
FIG. 6 is a partial cross sectional view taken along lines 6-6 of FIG. 5.
Figure 7:
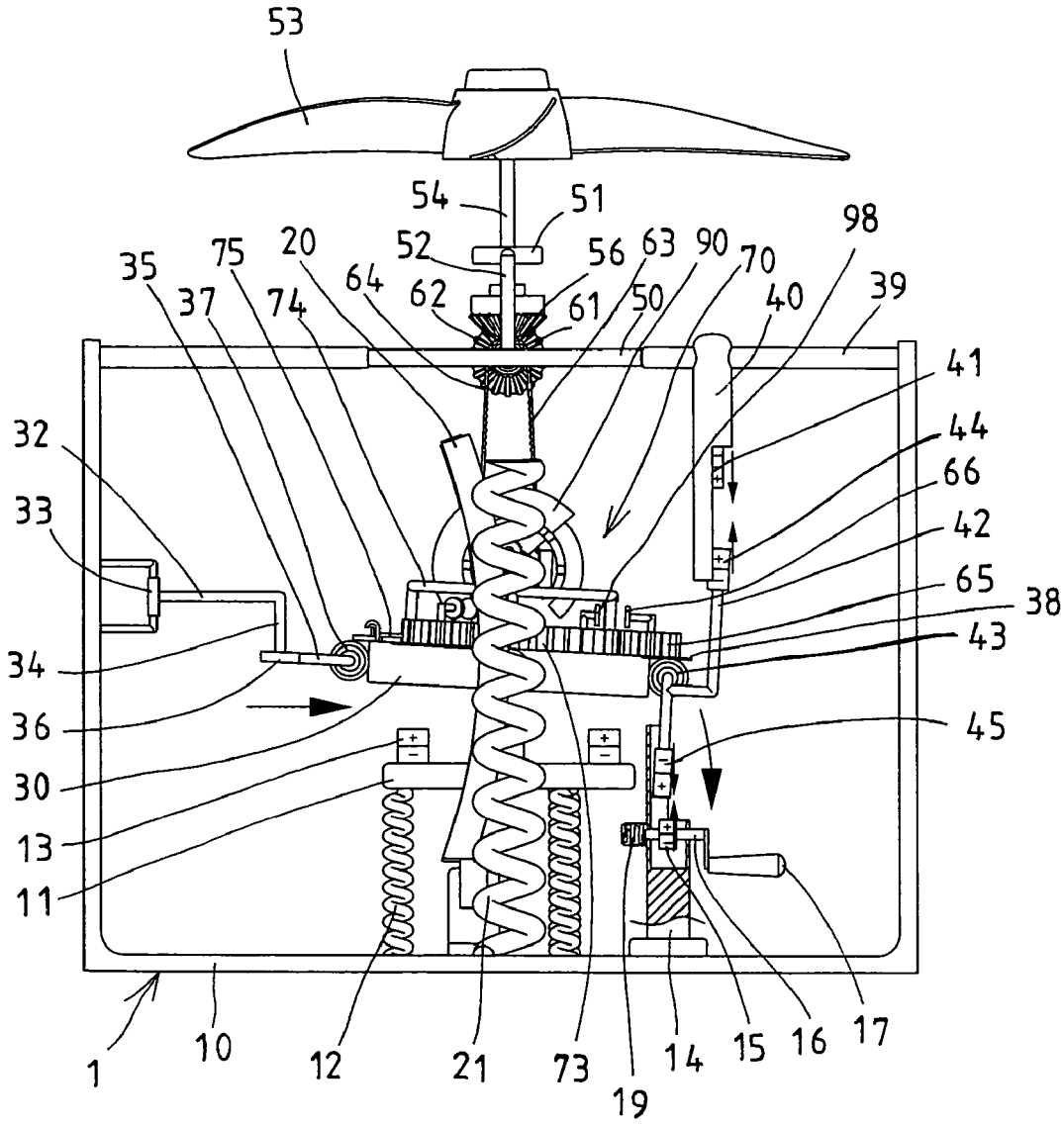
FIG. 7 is a plan view similar to FIG. 4, illustrating the operation of the magnetically operated fan device.
Figure 8:
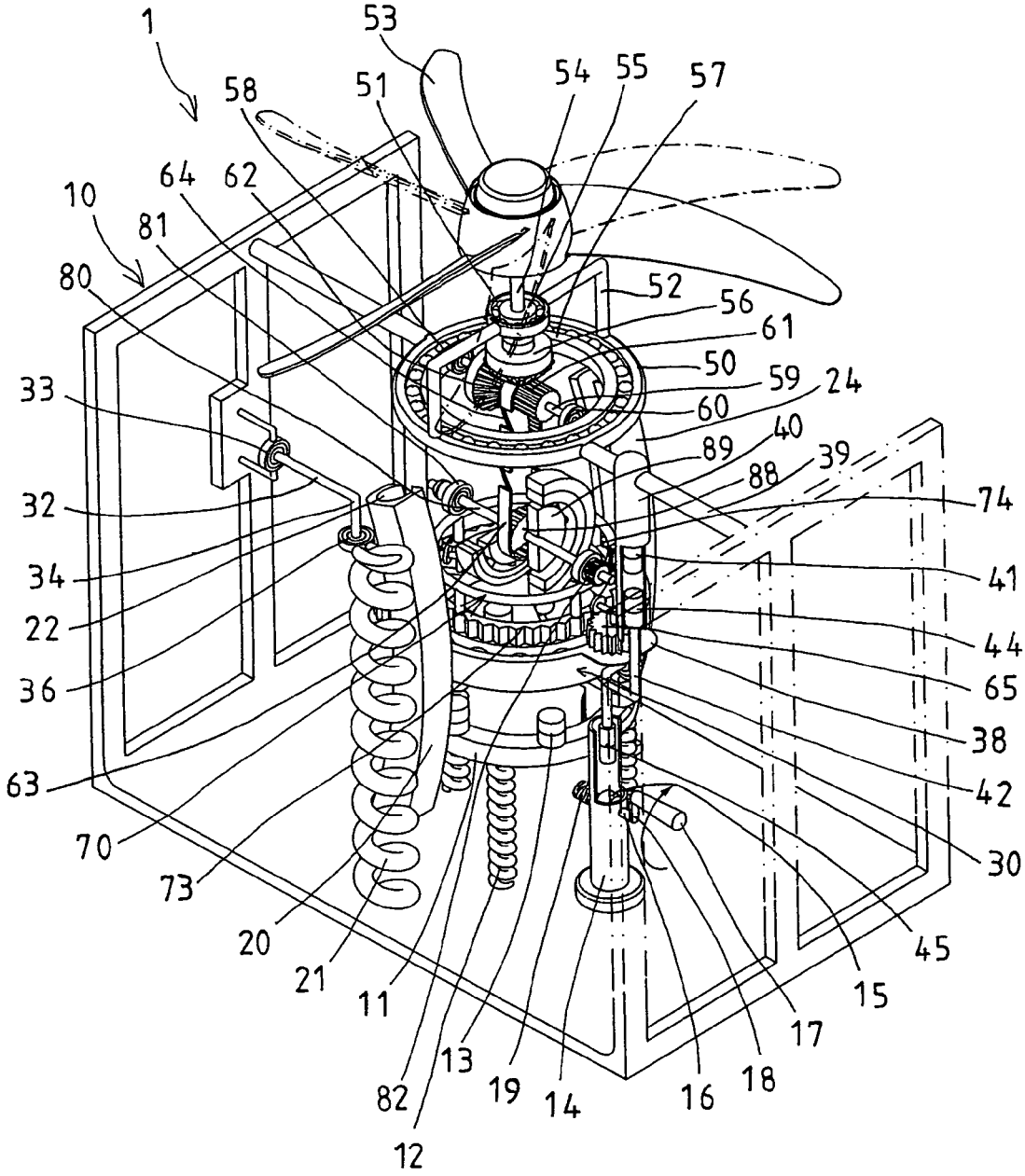
FIG. 8 is a perspective view similar to FIG. 1, illustrating the operation status of the magnetically operated fan device as shown in FIG. 7.
Figure 9:
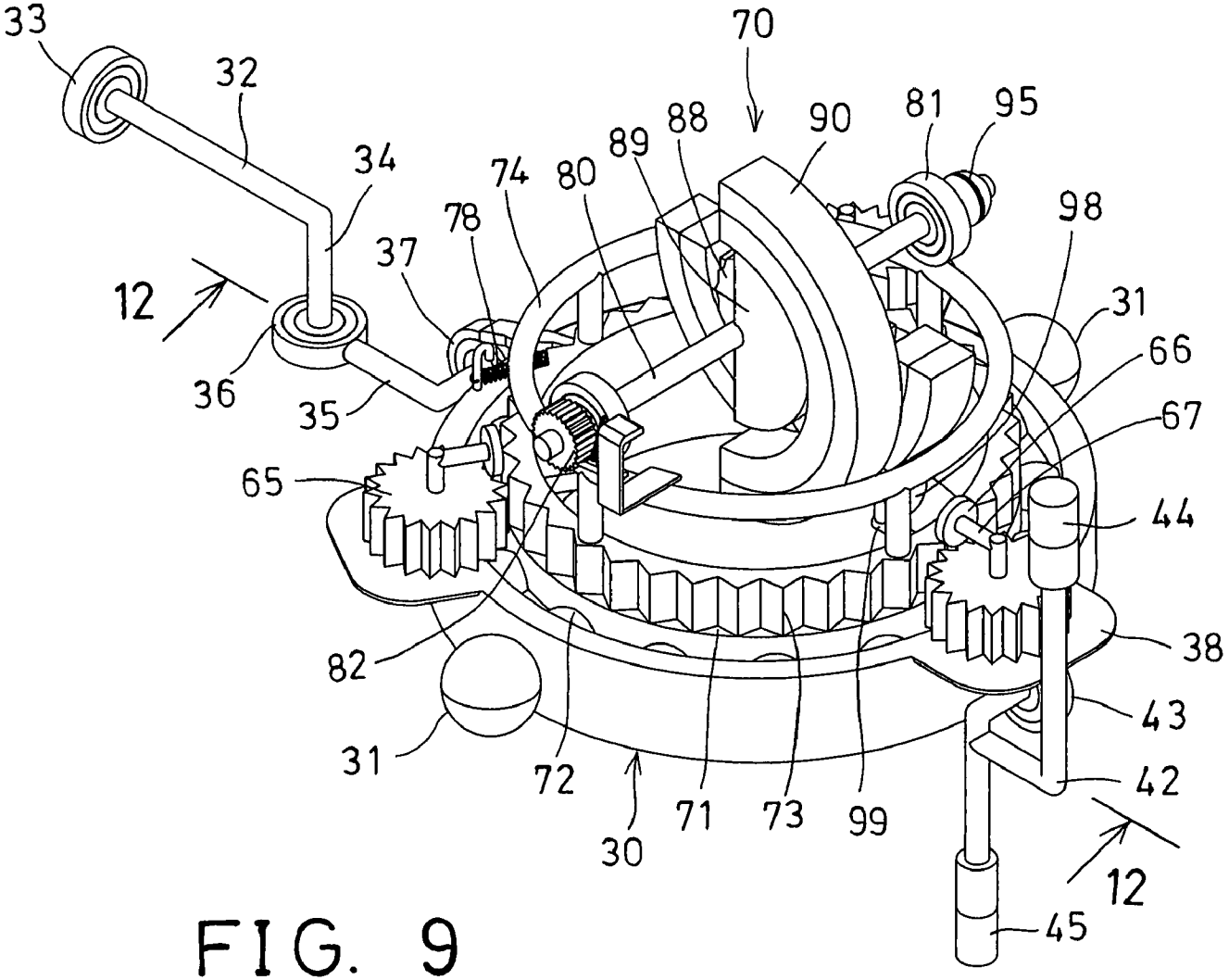
FIG. 9 is an enlarged partial perspective view illustrating a magnetic operating or driving device of the magnetically operated fan device.
Figure 11:
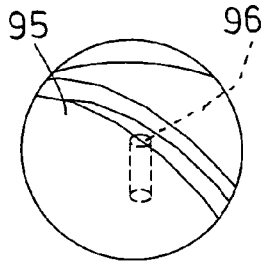
FIG. 11 is an enlarged partial perspective view of the magnetic driving device of the magnetically operated fan device.
Figure 10:
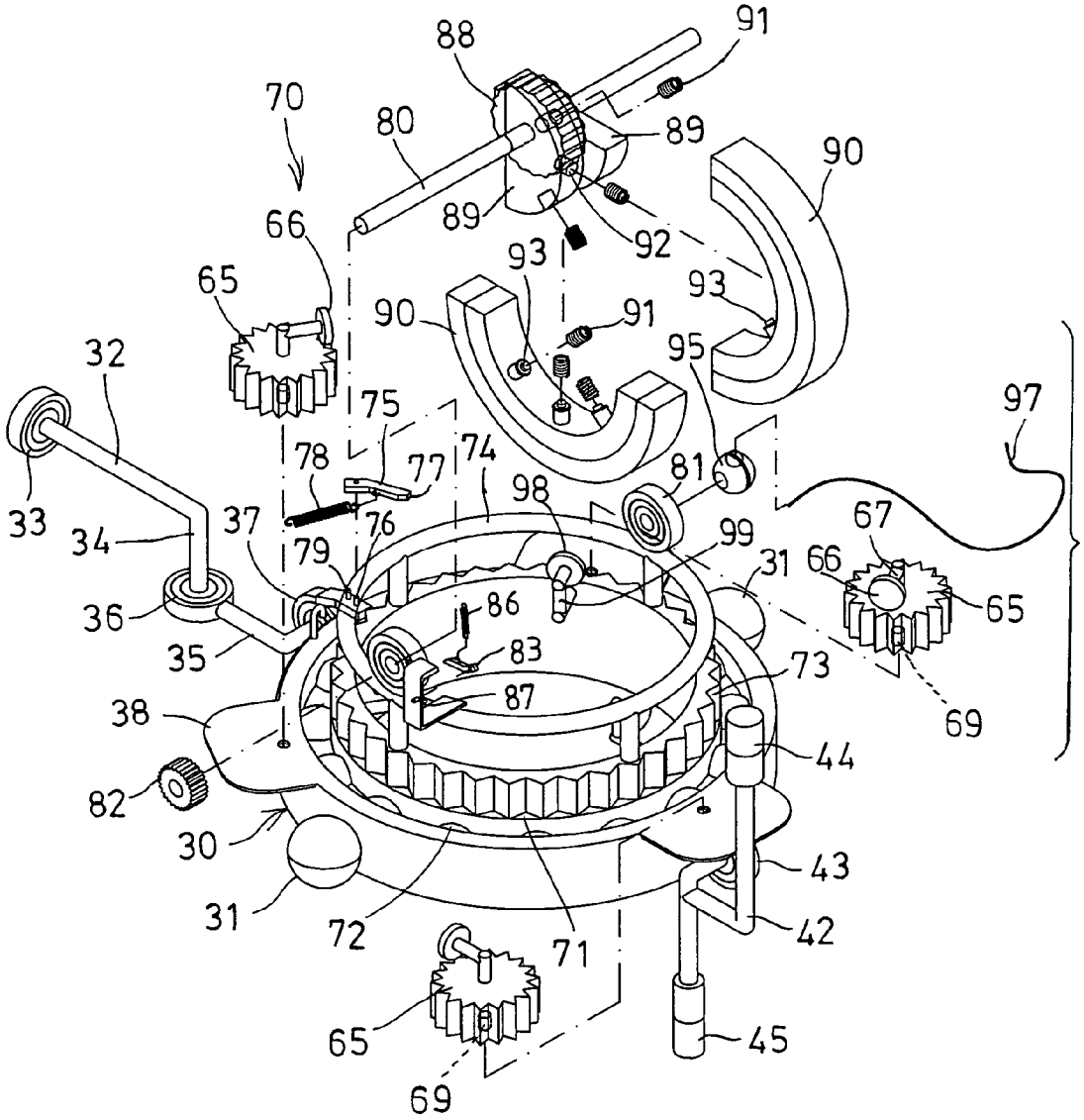
FIG. 10 is a partial exploded view of the magnetic operating or driving device of the magnetically operated fan device.
Figure 13:
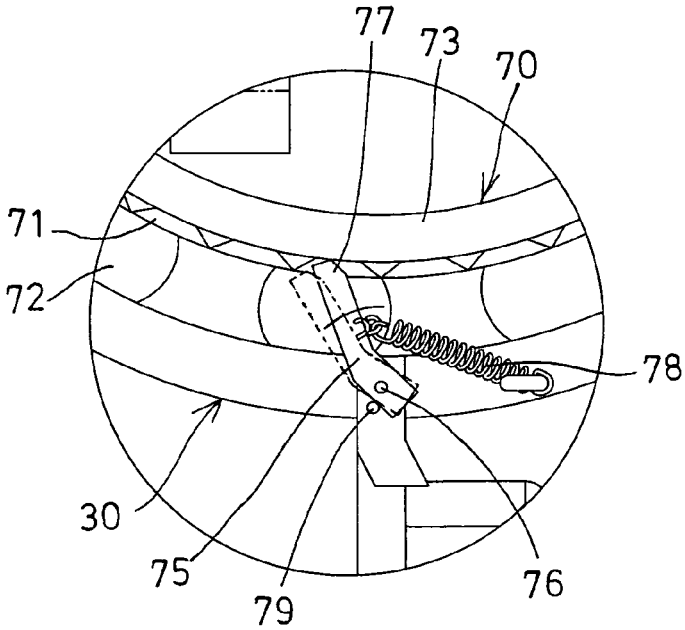
FIG. 13 is an enlarged partial plan schematic view of the magnetic driving device of the magnetically operated fan device.

As shown in FIGS. 5, 10, and 13, a pawl 75 has one end rotatably or pivotally attached to the base 30 with a pivot pin 76, and the other end 77 (FIG. 13) for engaging with the gear 73, a spring member 78 is coupled between the pawl 75 and the base 30, to bias or to force the other end 77 of the pawl 75 to engage with the gear 73, and thus to limit the gear 73 and thus the follower 71 to rotate in one direction relative to the base 30 only, and to prevent the gear 73 and thus the follower 71 to rotate in the opposite direction relative to the base 30. The base 30 may include a stop 79 extended therefrom, for engaging with the pawl 75, and thus for limiting the rotational movement of the pawl 75 relative to the base. 30.

Figure 14:
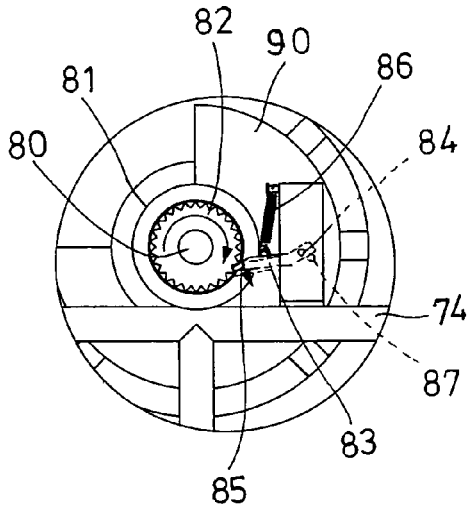
FIG. 14 is another enlarged partial plan schematic view of the magnetic driving device of the magnetically operated fan device.

An axle 80 is rotatably attached or secured to the frame 74 of the follower 71 with one or more bearings or pivot joints 81, and includes a pinion 82 attached to one end thereof. As shown in FIG. 14, another pawl 83 has one end rotatably or pivotally attached to the frame 74 or the follower 71 with a pivot pin 84, and the other end 85 for engaging with the pinion 82, a spring member 86 is coupled between the pawl 84 and the frame 74 or the follower 71, to bias or to force the other end 85 of the pawl 83 to engage with the pinion 82, and thus to limit the pinion 82 and thus the axle 80 to rotate in one direction relative to the frame 74 or the follower 71 only, and to prevent the pinion 82 to rotate in the opposite direction relative to the frame 74 or the follower 71. The frame 74 or the follower 71 may include a stop 87 extended therefrom, for engaging with the pawl 83, to limit the rotational movement of the pawl 83 relative to the frame 74 or the follower 71.

The axle 80 includes a sprocket or a pinion 88 and one or more eccentric members 89 attached or secured to the axle 80, and rotated in concert with the axle 80, for increasing moment of inertia of the axle 80. The coupling member 63 or the chain or the belt 63 is also engaged with the sprocket or a pinion 88, in order to couple the shaft 59 and the axle 80 together (FIGS. 4, 8, 12, 17), and thus to allow the fan member 53 to be rotated or driven by the axle 80 via the shaft 59. The pinions 61, 77 and the bevel gears 56, 62, and the coupling member 63 may thus be formed as a coupling means or device for coupling the axle 80 to the fan member 53, in order to drive the fan member 53.

A magnetic member 90 is attached to each of the eccentric members 89, and one or more spring members 91 are preferably disposed between the magnetic members 90 and the eccentric members 89 respectively, to resiliently attach the magnetic members 90 and the eccentric members 89 respectively. The spring members 91 may be partially received in cavities 92 of the eccentric members 89, and the magnetic members 90 may each include one or more studs 93 extended therefrom and slidably engaged through the spring members 91, and engaged into the cavities 92 of the eccentric members 89, to guide the magnetic members 90 to slightly slide relative to the eccentric members 89 respectively, and thus to allow the magnetic members 90 to be resiliently attached to the eccentric members 89 respectively.

As shown in FIGS. 9-11 and 15-16, a ball or a pulley 95 is attached or secured to the axle 80, and includes a hole 96 formed therein (FIG. 11) for receiving one end of a cable or rope 97, and the rope 97 may be engaged around the pulley 95, and may be pulled by the users (FIG. 15), to have the axle 80 and thus the magnetic members 90 to start to rotate relative to the support element 11 and the magnetic members 13 of the housing 10 (FIG. 12), and thus to allow the magnetic members 13, 90 to be acted with each other to bias or to force the axle 80 to continuously rotate relative to the support element 11 and the housing 10.

The eccentrically attachment of the eccentric members 89 and the magnetic members 90 on the axle 80 may increase the moment of inertia of the axle 80, and may further maintain the rotational movement of the axle 80 relative to the support element 11 and the housing 10, in order to continuously rotate or drive the fan member 53 by the magnetic force generated between the magnetic members 13, 90.

As shown in FIGS. 6-7, 9-10, 12, one or more, such as three magnetic members 98 may further be provided and attached to the follower 71 with extensions 99, and rotated in concert with the follower 71. As shown in FIGS. 4-10 and 12, one or more, such as three pinions 65 may further be provided and rotatably or pivotally attached to the base 30 or the platforms 38 of the base 30 with pivot pins 69 (FIG. 10), and a magnetic member 66 may further be provided and attached to each pinion 65 with an extensions 67, and rotated in concert with the respective pinion 65. The magnetic members 66, 98 may be acted with each other to bias or to force the follower 71 and the frame 74 and the gear 73 to continuously rotate relative to the base 30.

The follower 71 and thus the frame 74 and the axle 80 are rotatably supported in the base 30, and the rotary member 57 and the fan member 53 are also rotatably attached or secured in the casing 50 of the housing 10, such that the follower 71 and the frame 74 and the axle 80 and the rotary member 57 and the fan member 53 may be rotated in concert relative to the casing 50 and the housing 10. The follower 71 and the frame 74 and the axle 80 may be caused to be rotated relative to the base 30 when the eccentric members 89 and the magnetic members 90 are rotated relative to the follower 71 and the frame 74, for example. The rotatable movement of the follower 71 and the frame 74 relative to the base 30 allows the eccentric members 89 and the magnetic members 90 to be freely rotated relative to the follower 71 and the frame 74. The magnetic members 13, 66, 90, 98 are preferably made of magnetic materials having about 4000~6000 Gausses.

Figure 15:
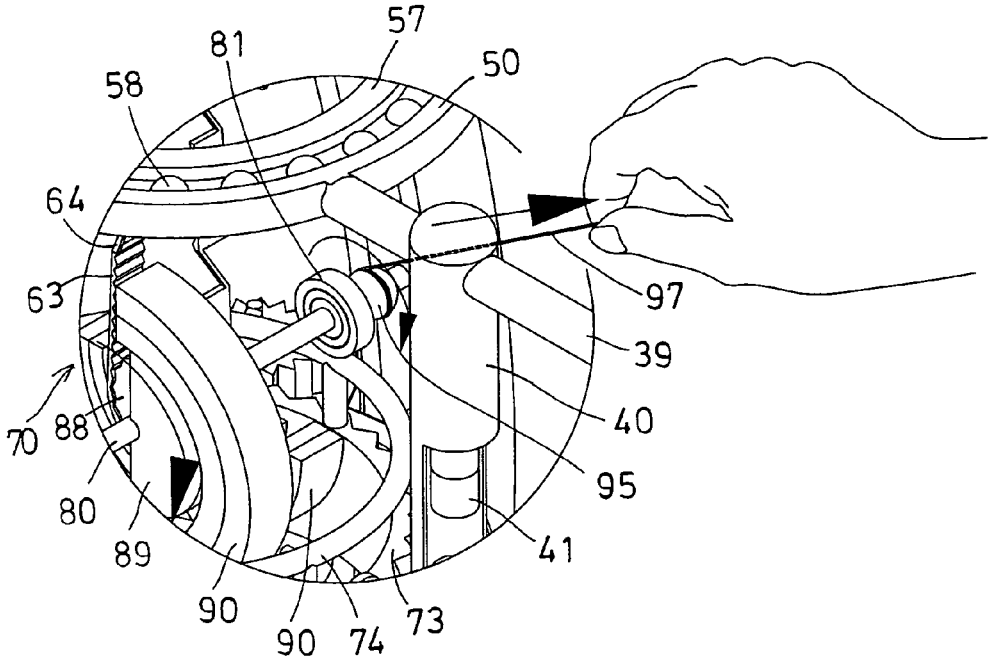
FIG. 15 is an enlarged partial perspective view illustrating the operation of the magnetic driving device of the magnetically operated fan device.
Figure 16:
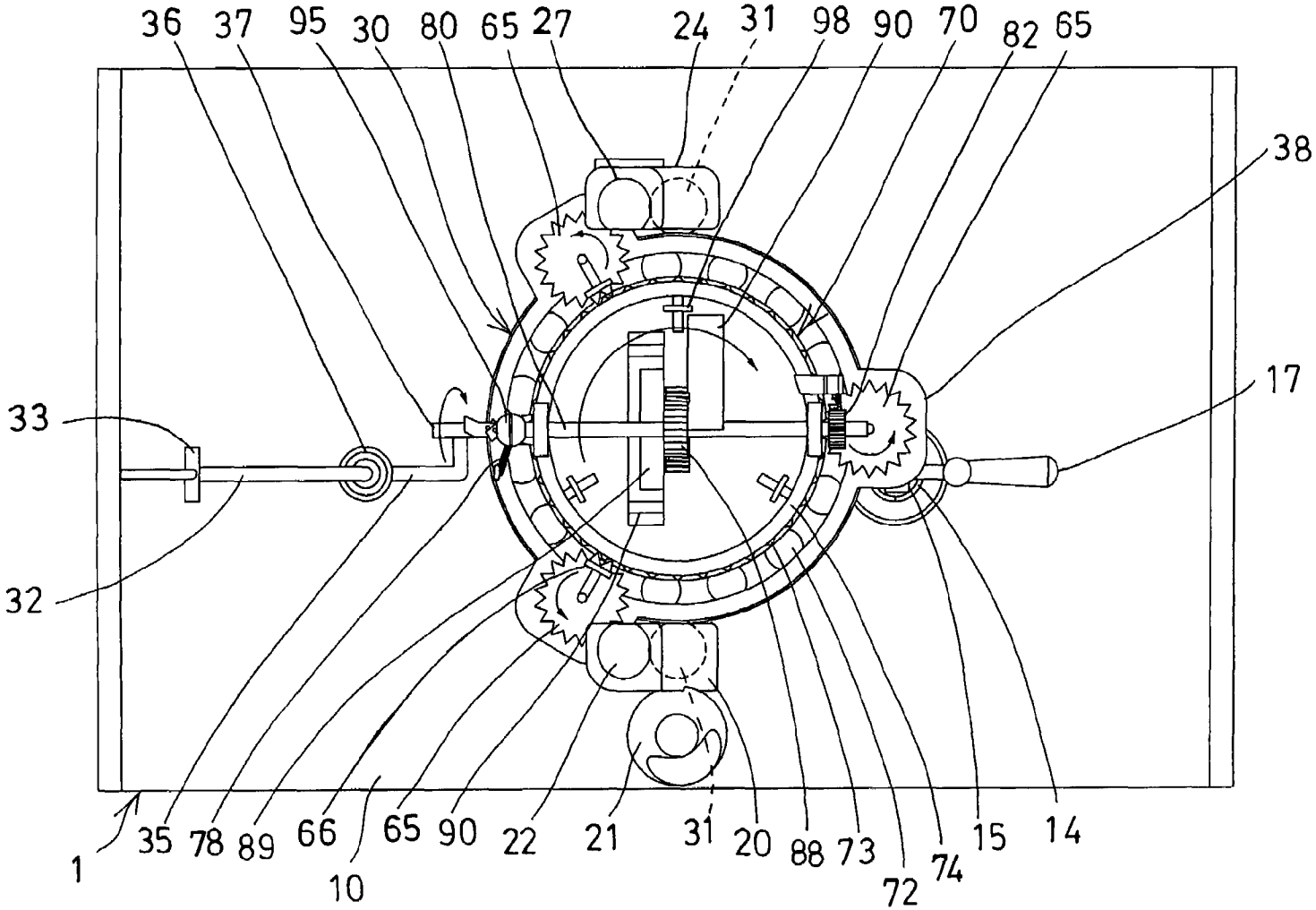
FIG. 16 is a partial cross sectional view similar to FIG. 5, illustrating the operation of the magnetic driving device of the magnetically operated fan device.
Figure 17:
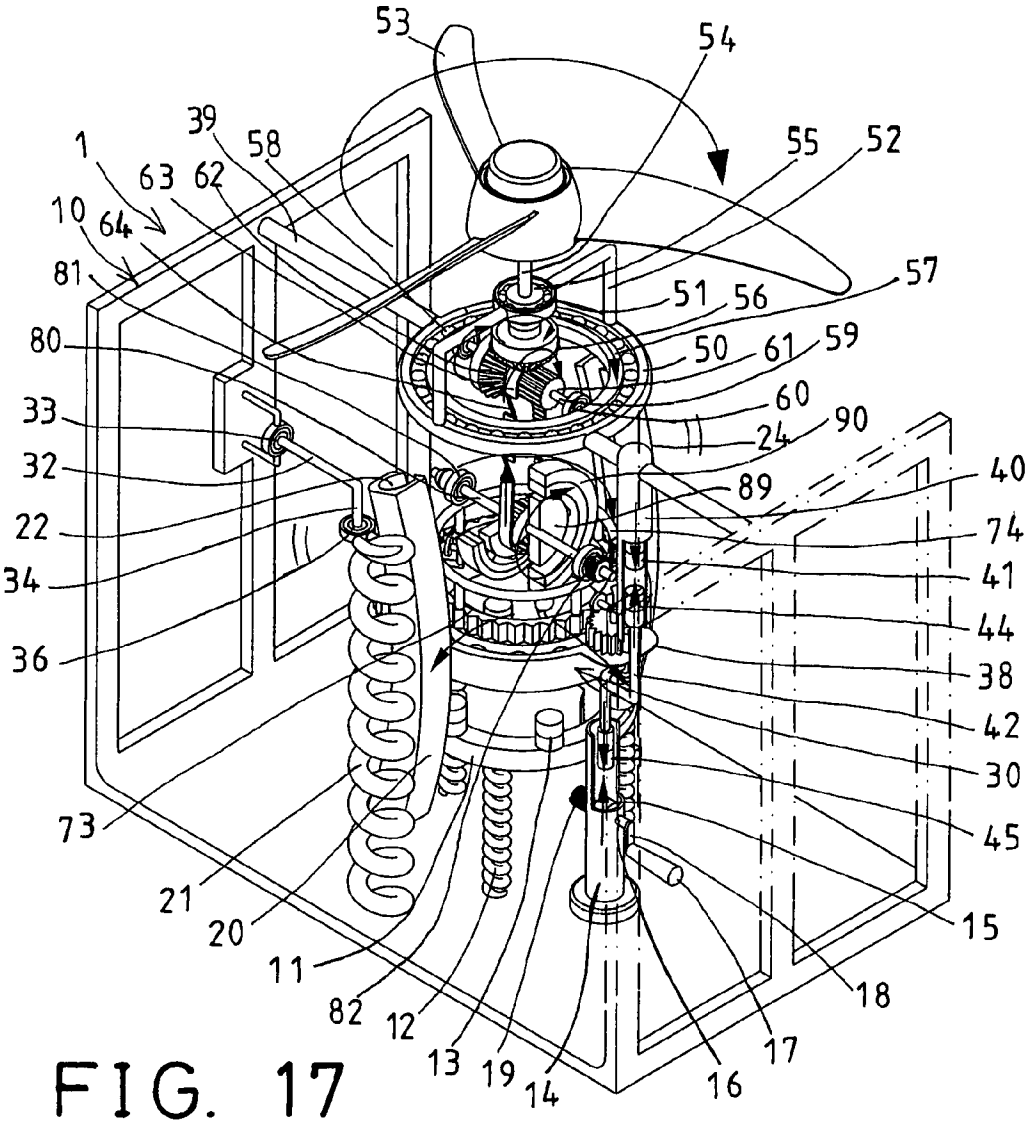
FIG. 17 is a perspective view similar to FIGS. 1 and 8, illustrating the operation of the magnetic driving device of the magnetically operated fan device.

In operation, as shown in FIG. 15, when the axle 80 and the pulley 95 are rotated by the rope 97, the eccentric members 89 and the magnetic members 90 and the axle 80 may thus be rotated relative to the follower 71 and the frame 74 and the housing 10, and the magnetic members 13, 90 may be acted with each other to generate magnetic forces, and to continuously rotate or drive the axle 80, and thus to continuously rotate or drive the fan member 53 via the coupling member 63. The pawl 83 may be caused to engage with the pinion 82, to limit the pinion 82 and the axle 80 to rotate in one direction relative to the frame 74 or the follower 71 only, and to prevent the pinion 82 to rotate in the opposite direction relative to the frame 74 or the follower 71.

When the eccentric members 89 and the magnetic members 90 and the axle 80 are rotated relative to the follower 71 and the frame 74 and the housing 10, and the magnetic members 66, 98 may also be acted with each other to generate magnetic forces, and to continuously rotate or drive the axle 80, and thus to continuously rotate or drive the follower 71 and the frame 74 and the gear 73 to rotate relative to the base 30. The pawl 75 may be caused to engage with the gear 73, to limit the gear 73 and thus the follower 71 to rotate in one direction relative to the base 30 only, and to prevent the gear 73 and thus the follower 71 to rotate in the opposite direction relative to the base 30.

When it is required to stop the fan device 1, the magnetic member 15 may be rotated relative to the seat 14 by the handle 17, to have the magnetic poles of the magnetic member 15 to be rotated and changed to attract the magnetic members 45 downwardly toward the magnetic members 15, and thus to tilt the base 30 relative to the housing 10. When the base 30 is tilted relative to the housing 10, the eccentric members 89 and the magnetic members 90 may also be tilted relative to the follower 71 and the frame 74 and the housing 10, such that the eccentric members 89 and the magnetic members 90 and the axle 80 may not be smoothly rotated relative to the follower 71 and the frame 74 and the housing 10, and such that the axle 80 may then be stopped.

When the handle 17 is released by the users, the rod 16 and thus the magnetic member 15 may then be biased and recovered back to the original or required position by the spring biasing or recovering member 19, where the same magnetic poles of the magnetic members 15, 45 are faced toward each other (FIG. 4), in order to bias the base 30 upwardly relative to the housing 10 again, and so as to suspend or float the base 30 in the housing 10 at the original or required horizontal status or position.

Accordingly, the magnetically operated fan device in accordance with the present invention may be automatically operated or driven with magnetic materials or members without consuming valuable and expensive electric energy.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A magnetically operated fan device comprising:

a housing, a fan member rotatably supported on said housing, at least one first magnetic member disposed in said housing, a base supported in said housing, a follower rotatably attached to said base, and including a frame provided thereon, an axle rotatably attached to said frame of said follower, and including at least one eccentric member attached to said axle and rotated in concert with said axle, for increasing moment of inertia of said axle, a second magnetic member attached to said at least one eccentric member, for acting with said at least one first magnetic member of said housing, to bias and force said axle to continuously rotate relative to said frame of said follower and said housing, and means for coupling said axle to said fan member, to have said fan member to be rotated and driven by said axle and by continuous rotation of said second magnetic member and said at least one eccentric member and said axle relative to said frame of said follower and said housing.

2. The magnetically operated fan device as claimed in claim 1 further comprising at least one spring member disposed between said second magnetic member and said at least one eccentric member.

3. The magnetically operated fan device as claimed in claim 2, wherein said at least one eccentric member includes at least one cavity formed therein to partially receive said at least one spring member.

4. The magnetically operated fan device as claimed in claim 3, wherein said second magnetic member includes at least one stud extended therefrom to engage through said at least one spring member.

5. The magnetically operated fan device as claimed in claim 1, wherein said coupling means includes a rotary member rotatably attached to said housing, a shaft rotatably attached to said rotary member and coupled to said fan member, a first pinion disposed on said shaft, a second pinion disposed on said axle, and a coupling member engaged with said first and said second pinions, to couple said shaft and said axle together, and to allow said fan member to be rotated and driven by said axle via said shaft.

6. The magnetically operated fan device as claimed in claim 5, wherein said housing includes a casing provided thereon, and said fan member includes a spindle rotatably attached to said casing, a first bevel gear attached to said spindle and rotated in concert with said spindle, and a second bevel gear attached to said shaft, and engaged with said first bevel gear.

7. The magnetically operated fan device as claimed in claim 1, wherein said axle includes a pulley attached thereon, and a rope for engaging around said pulley, and for rotating said axle with said pulley.

8. The magnetically operated fan device as claimed in claim 1, wherein said axle includes a pinion attached thereto, and a pawl pivotally attached to said frame, and biased to engage with said pinion, in order to limit a rotational movement of said axle relative to said frame.

9. The magnetically operated fan device as claimed in claim 1, wherein said follower includes a gear provided thereon, and a pawl pivotally attached to said base, and biased to engage with said gear, in order to limit a rotational movement of said gear and said follower relative to said base.

10. The magnetically operated fan device as claimed in claim 1, wherein an arm is pivotally attached to said base and includes a third magnetic member disposed thereon, said housing includes a fourth magnetic member rotatably disposed therein and arranged for acting with said third magnetic member, to either bias said third magnetic member and thus said arm and said base away from said fourth magnetic member.

11. The magnetically operated fan device as claimed in claim 10, wherein said housing includes a seat disposed therein and having said fourth magnetic member rotatably attached to said seat with a rod, and a handle coupled to said rod to rotate said rod and said fourth magnetic member relative to said seat and said third magnetic member, and a spring member for recovering said rod and said fourth magnetic member.

12. The magnetically operated fan device as claimed in claim 10, wherein said arm includes a fifth magnetic member disposed thereon, said housing includes a column attached thereto and having a sixth magnetic member disposed therein for acting with said fifth magnetic member, to balance said fifth magnetic member and thus said arm and said base relative to said housing.

13. The magnetically operated fan device as claimed in claim 1, wherein said housing includes a horizontal beam pivotally attached thereto and having an extension extended downwardly therefrom and pivotally attached to a lever, and said lever is pivotally attached to said base, to allow said base to slightly move freely relative to said housing.

14. The magnetically operated fan device as claimed in claim 1, wherein said follower includes a third magnetic member attached thereto and includes a gear provided thereon, and said base includes at least one pinion rotatably attached thereto and a fourth magnetic member attached to said at least one pinion, for acting with said third magnetic member, and to bias and to rotate said follower relative to said base.

15. The magnetically operated fan device as claimed in claim 14, wherein said base includes at least one platform extended therefrom, to rotatably support said at least one pinion.

16. The magnetically operated fan device as claimed in claim 1, wherein said housing includes a first track and a second track disposed thereon, and each having a third magnetic member attached thereto, said base includes two fourth magnetic members attached thereto and arranged to act with said third magnetic members of said tracks, to bias and force said base upwardly relative to said housing, and to suspend and float said base in said housing.

17. The magnetically operated fan device as claimed in claim 16, wherein said first track is attached to said housing with a spring member.

18. The magnetically operated fan device as claimed in claim 16, wherein said second track is attached to said housing with a protrusion and a pivot pin.

19. The magnetically operated fan device as claimed in claim 16, wherein said first and said second tracks each includes a channel formed therein to slidably receive said fourth magnetic members of said base.

* * * * *